US005745440A

United States Patent [19]

Chen

[11] Patent Number: 5,745,440

[45] Date of Patent: Apr. 28, 1998

[54] TIME EQUIPMENT WITH TIME ZONE MECHANISM

[76] Inventor: Eddie Zon Tsu Chen, 17411 Seco Ct., Rowland Heights, Calif. 91748

[21] Appl. No.: 665,307

[22] Filed: Jul. 17, 1996

[51] Int. Cl.[6] ..... G04B 19/22

[52] U.S. Cl. ..... 368/27; 368/21

[58] Field of Search ..... 368/21, 22, 23, 368/27, 190, 185

[56] References Cited

U.S. PATENT DOCUMENTS

| | | | |
|---|---|---|---|
| 428,588 | 5/1890 | Barrett | 368/27 |
| 1,513,317 | 10/1924 | Frakes | 368/27 |
| 1,974,357 | 9/1934 | Eklund | 368/27 |
| 1,990,012 | 2/1935 | Woodruff | 368/27 |
| 2,268,239 | 12/1941 | Braaten | 368/27 |
| 2,275,604 | 2/1942 | Booharin | 368/27 |
| 2,395,643 | 2/1946 | Ramsay | 368/27 |
| 3,675,411 | 7/1972 | Sakuma | 368/27 |
| 5,631,878 | 5/1997 | Chen | 368/27 |

*Primary Examiner*—Bernard Roskoski

*Attorney, Agent, or Firm*—David and Raymond; Raymond Y. Chan

[57] ABSTRACT

A time equipment with time zone mechanism includes a 24-hour dial, an hour hand and a minute hand mounted for rotating above said dial, a movement for driving said hour hand and minute hand to rotate one revolution per 24 hours, a time zone mechanism, and a setting mechanism for said time zone mechanism. The time zone mechanism comprises a time zone disc coaxially mounted under the dial and a driving device for driving the time zone disc to rotate one revolution per 24 hours. The time zone disc has an outer time zone ring portion disposed around the periphery of the dial and provided until a plurality of time zone city indicators arranged in the same order as the time zones. The setting mechanism is adapted to drive the time zone disc to rotate independently with one of the time zone city indicators representing a desired city of the time zones aligned with the hour hand, so that the current time of other time zone cities provided on the time zone disc can be read simultaneously coincident with the corresponding hour numerals inscribed on the dial respectively.

7 Claims, 16 Drawing Sheets

TIME EQUIPMENT WITH TIME ZONE MECHANISM

BACKGROUND OF THE PRESENT INVENTION

The present invention relates to time equipment such as watch and clock, and more particularly to a time equipment with time zone mechanism which has a time zone disc being driven to rotate automatically one revolution per 24 hours so as to enable one of the time zone city marks which represents the local city rotating simultaneously and following the rotation of an hour hand of the time equipment. Furthermore, the time zone city marks of the time zone disc are capable of maintaining in upright position during the rotation of the time zone disc so as to facilitate the reading of the time zone city marks corresponding with the hour inscriptions on the dial.

Providing, a time zone ring, which has a plurality of city inscriptions thereon to incorporate with a 24-hour timepiece for enabling the indication of simultaneous time display for two time zones is a well known skill per se for conventional timepiece.

As shown in FIG. 1, a conventional 24-hour timepiece 1 with an exterior time zone ring 11 mounted on an outer rim 12 of the timepiece 1 in the usual manner is illustrated. When the user needs to observe the time of another time zone city other than the local time pointing by an hour hand 13, the user has to hand turn the exterior time zone ring 11 until the local city name corresponding to an hour hand point 131 so that the user can read the current time of another city from a dial 14 coincident with the city name on the time zone ring 11. Since the user has to rotate the time zone ring 11 every time when the user needs to observe the current time of another city, it is very troublesome and violates the principle of user's friendly.

As shown in FIG. 2, another conventional timepiece 2 with a time zone ring 21 mounted on the outer rim of the dial 22 and an interior 24-hour rotating disc 23 mounted on the central portion of the dial 22 of the timepiece 2 in the usual manner is illustrated. When the user travels to another time zone city, the user has to adjust an hour hand 24 and a minute hand 25 to local time and then rotate the time zone ring 21 until the local time coincident with the local city name on the time zone ring 21, so that the user can read the current time of the other cities form a 24-hour dial 23 coincident with the city name on the time zone ring 21. However, those users, who need to travel city to city often, may still feel very inconvenience to the necessity of adjusting the hour hand 24 and minute hand 25 corresponding to the local time every time.

A timepiece with simultaneous time display for at least two time zones is disclosed in U.S. Pat. No. 5,323,363. It is convenience for travelers who always travel between two cities only. However, such timepiece is limited to simultaneously display the time of two time zones only. If the user travels to a third city, the user has to reset the timepiece again and the setting procedure is very troublesome. Firstly, adjust the time indicated by the hour and minute hands corresponding to a time zone city in an usual manner, in which one is corresponding to another time zone city. Secondly, operate the time zone disc to display the name of city corresponding to the local time zone and, during this operation, the 24-hour disc is also driven in rotation synchronically with the time zone disc, but the time indicated by the numeral of the 24-hour disc, in this stage, opposite the mark after the rotation of the time zone disc generally does not correspond to the time indicated by the hour hand. In such a case, the two indications of time should be made to correspond, which is achieved by a third step of operating solely the 24-hour disc in such manner that, the numeral coming opposite the mark corresponds to the time indicated by the hour hand. Moreover, one has to take into account whether the time indicated on the dial by the hour hand is a day time or a night time.

An essential common unsolved problem of every conventional timepiece with time zone ring, including the timepieces as mentioned above, is that the city name inscriptions are inscribes on the time zone disc radically that only the city name inscription at the 12 o'clock position is in upright position. Accordingly, those city name inscriptions located on the lower portion of the time zone disc, i.e. the 3 o'clock to the 9 o'clock positions, are turned upside-down that increases the difficulty of searching the desired city name by the user.

SUMMARY OF THE PRESENT INVENTION

It is a main object of the present invention to provide a time equipment with time zone mechanism which has a time zone disc being driven to rotate automatically one revolution per 24 hours so as to enable one of the time zone city marks which represents a predetermined city to rotate simultaneously, following the rotation of an hour hand of the time equipment. Therefore, the user may simultaneously observe all the current time of all the time zone city marks provided on the time zone disc.

It is another object of the present invention to provide a time equipment with time zone mechanism in which all the time zone city names or symbols provided on the time zone disc are capable of maintaining in upright position during, the rotation of the time zone disc so as to facilitate the reading of the time zone city names or symbols thereon.

It is still another object of the present invention to provide a time equipment with time zone mechanism which permits the hour hand to be driven to rotate independently for facilitating the setting procedure of the time equipment.

Accordingly, a time equipment with time zone mechanism of the present invention comprises a 24-hour dial, an hour hand and a minute hand mounted for rotating above the dial, a movement for driving the hour hand to rotate one revolution per 24 hours and the minute hand to rotate one revolution per hour, a time zone mechanism, and a setting mechanism for the time zone mechanism. The time zone mechanism comprises a time zone disc coaxially mounted adjacent to the dial and a driving device for driving the time zone disc to rotate one revolution per 24 hours. The time zone disc has an outer time zone ring portion disposing around the periphery of the dial and providing with a plurality of time zone city indicators arranged in the same order as the time zones. The setting, mechanism is adapted to rotate the time zone disc until one of the time zone city indicators representing a desired city of the time zones aligned with the hour hand so that the current time of the other time zone city indicators on the time zone disc are capable of being read simultaneously coincident with a plurality of corresponding hour numerals inscribed on the dial respectively.

The time equipment of the present invention further comprises a maintaining mechanism incorporated with the time zone mechanism, in which the time zone disc has a plurality of time zone openings and each of the time zone indicators comprises an indicating city disc. Each of the indicating city discs has a corresponding time zone city or symbol inscribed thereon and is supported to dispose on the corresponding time zone opening during the rotation of the time zone disc by means of the maintaining mechanism. The maintaining mechanism is further adapted to drive the plurality of indicating city discs to rotate independently so as to enable the time zone city or symbol of each indicating city disc maintaining in upright position during the rotation of the time zone disc.

The time equipment of the present invention further comprises an hour axle transmitting and setting device for enabling the hour hand to be transmitted to rotate one revolution per 24 hours by a minute axle which is driven to rotate one means of the movement, and for permitting the hour hand to be driven to rotate independently for facilitating the setting procedure of the time equipment.

DETAILED DESCRIPTION OF THE PREFERRED EMBODIMENT

Figure 1:
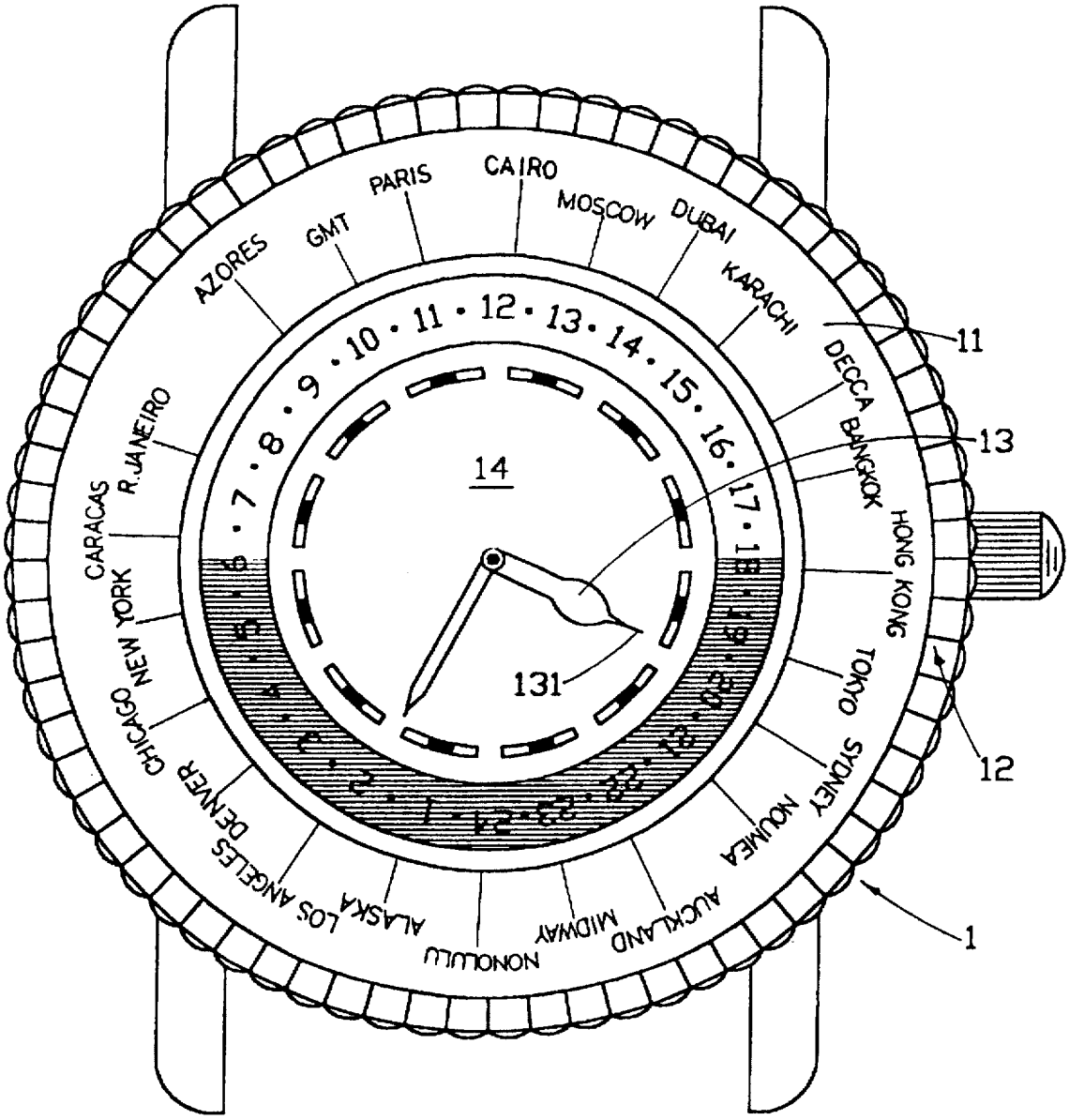
FIG 1 PRIOR ART
FIG. 1 is a front view of a conventional timepiece with a time zone ring mounted thereon.
Figure 2:
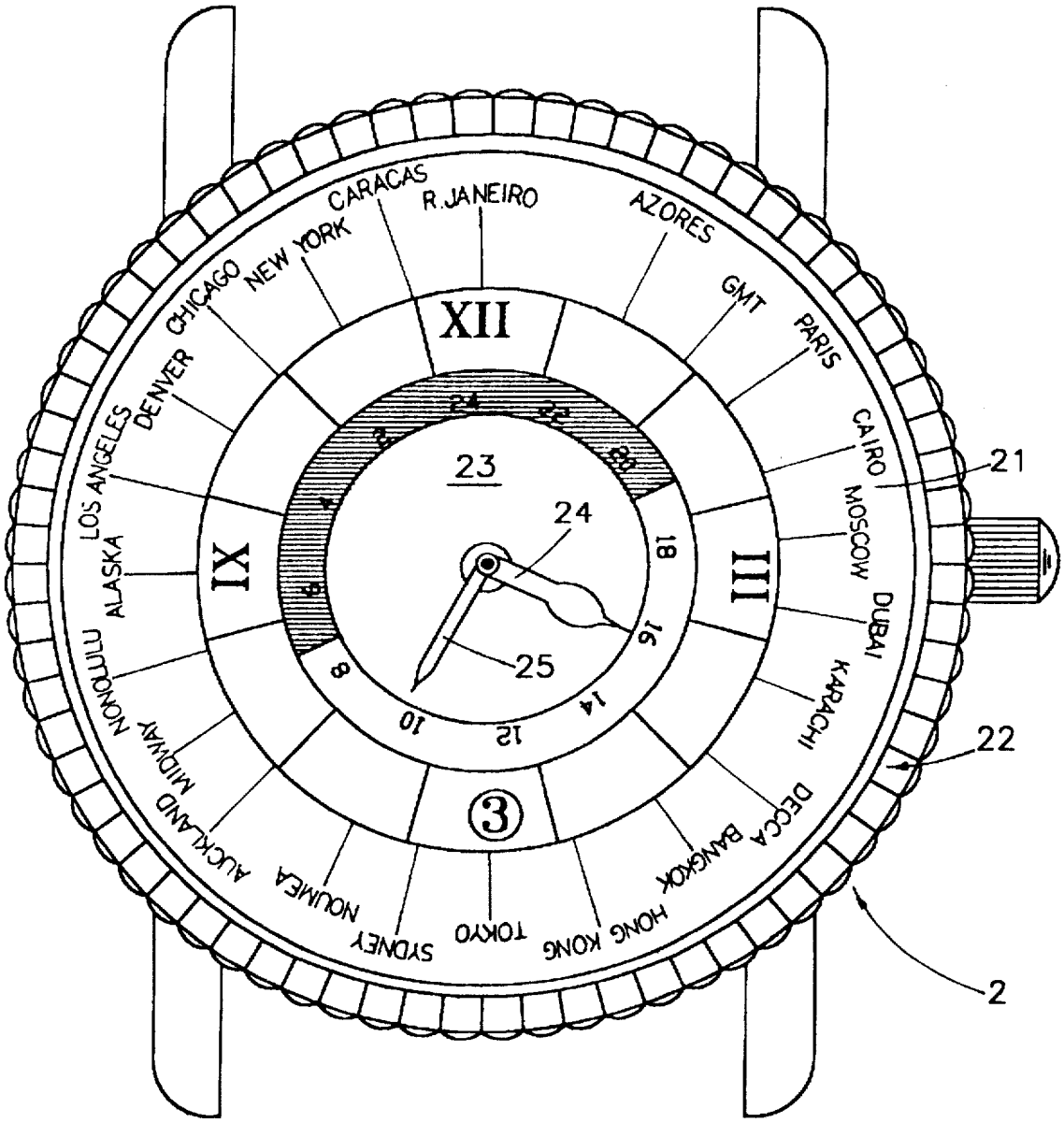
FIG 2 PRIOR ART
FIG. 2 is a front view of another conventional timepiece with a time zone ring mounted therein.
Figure 3:
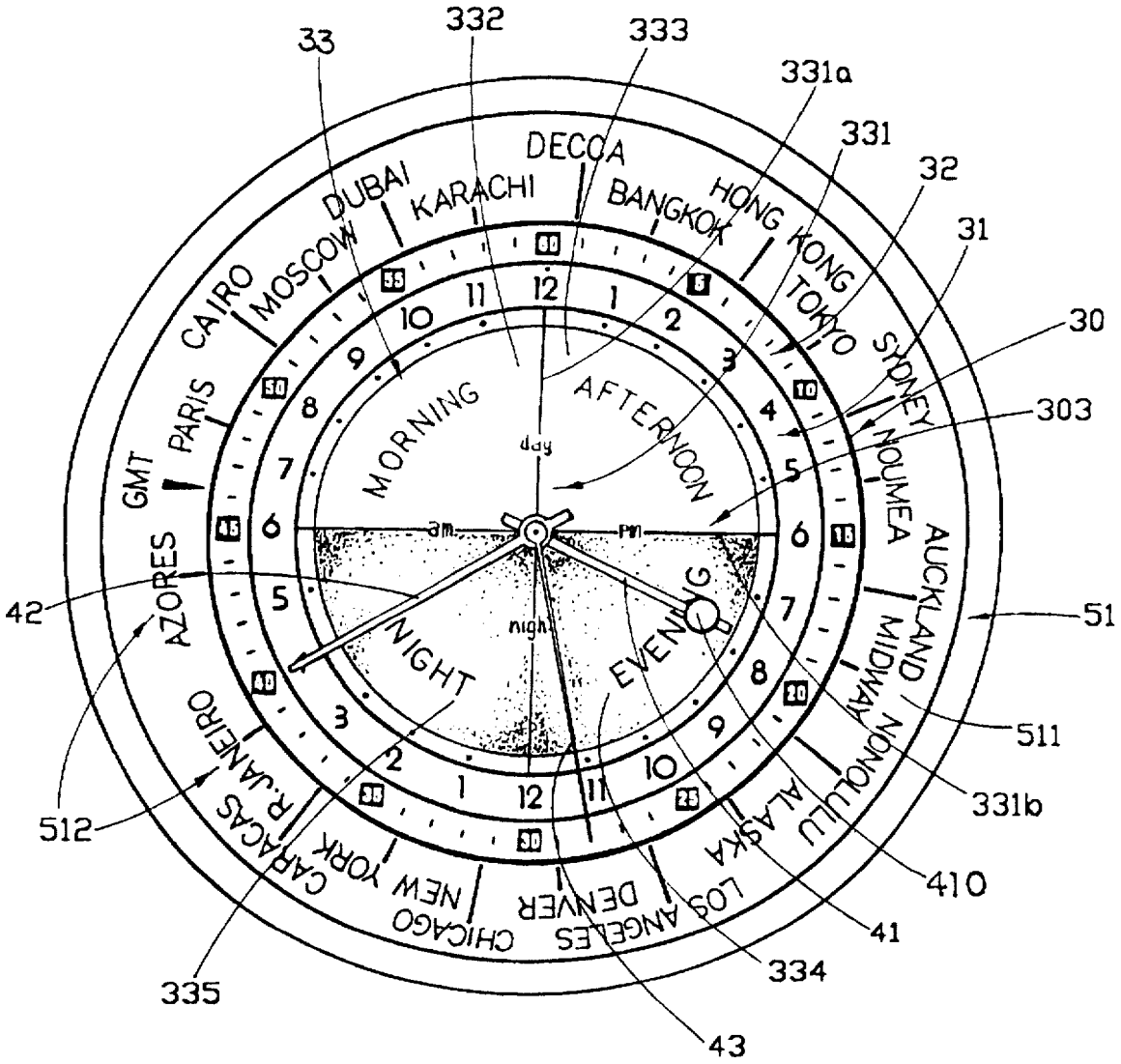
FIG. 3 front view of a time equipment having a 24-hour dial incorporated with a time zone disc according to a first preferred embodiment of the present invention.
Figure 4:
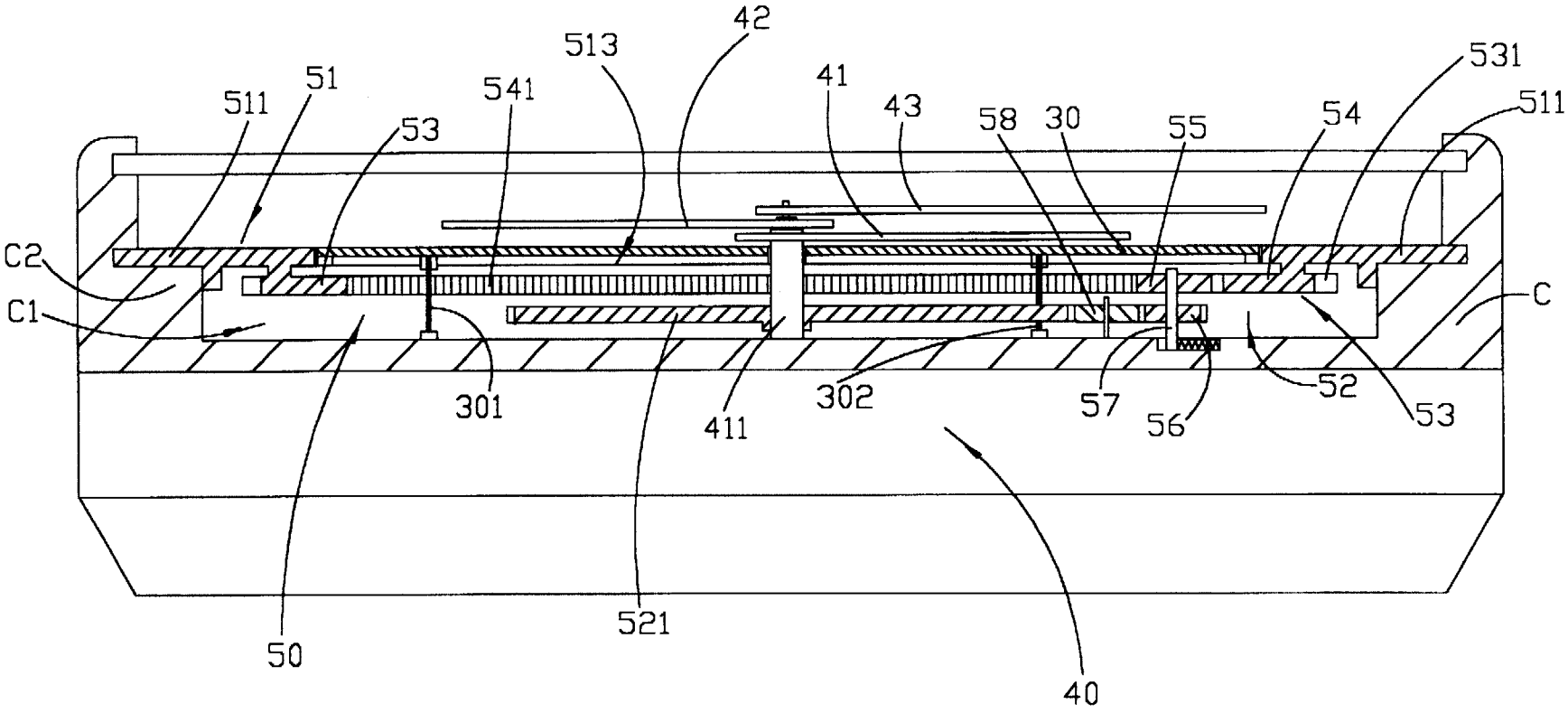
FIG. 4 is a schematic sectional view illustrating a driving device of the time equipment according to the above first embodiment of the present invention.
Figure 5:
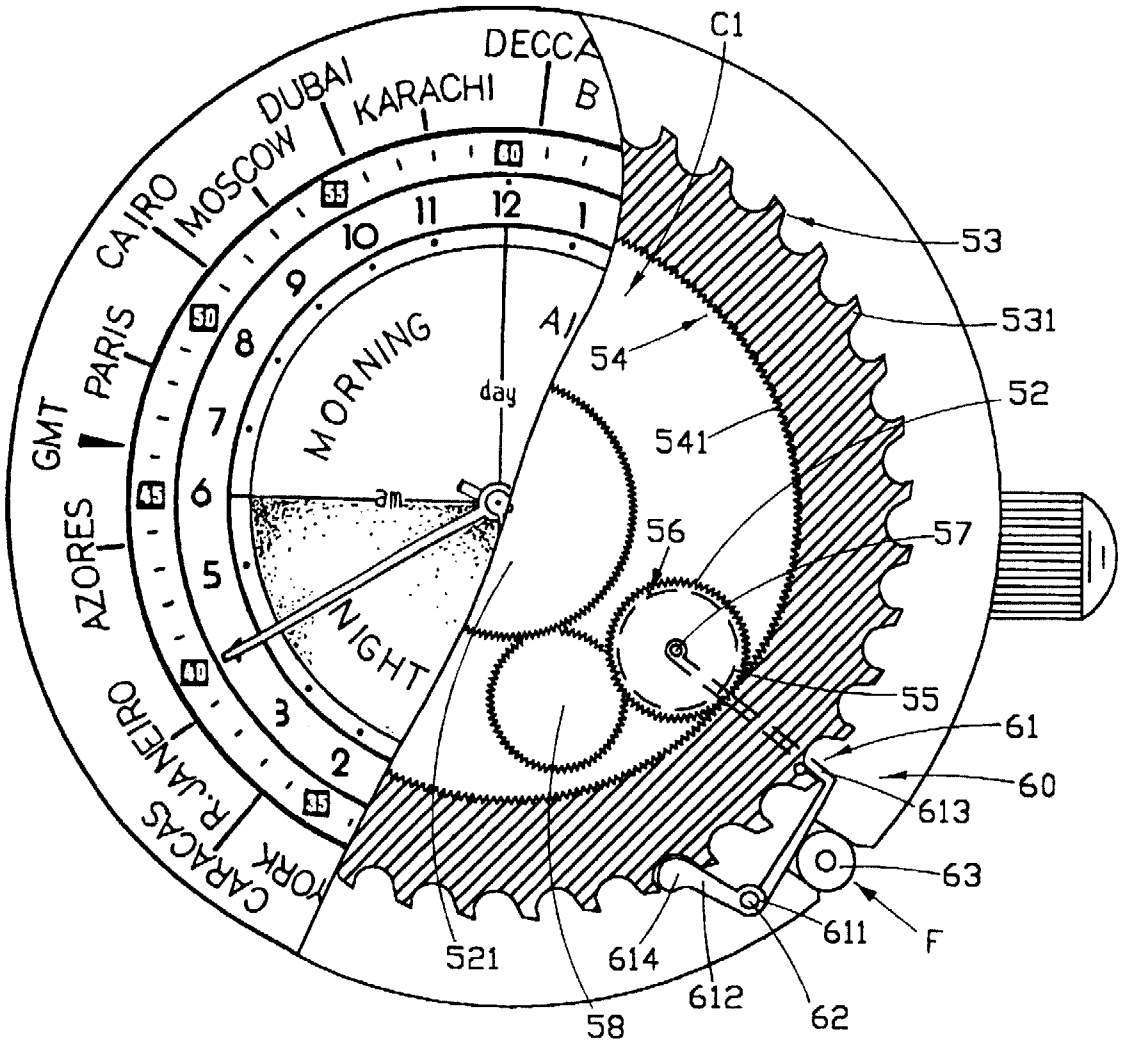
FIG. 5 is a partial sectional front view illustrating the driving device incorporated with a setting mechanism of the time equipment according to the above first embodiment of the present invention.

Referring to FIGS. 3 to 5 of the drawings, a time equipment with time zone mechanism of the present invention comprises a 24-hour dial 30, an hour hand 41, a minute hand 42 and a second hand 43 mounted for rotating above the dial 30, a movement 40 for driving the hour hand 41 to rotate one revolution per 24 hours, the minute hand 42 to rotate one revolution per hour and the second hand 43 to rotate one revolution per minute, a time zone mechanism 50 having a time zone disc 51 mounted adjacent to the dial 30 and a driving device 52 for driving the time zone disc 51 to rotate one revolution per 24 hours, and a setting mechanism 60 for the time zone mechanism 50 (as shown in FIG. 5).

The dial 30 has an hour sequence of numerals inscribed thereon and ordered by increasing value from 1–24 which are arranged circularly and evenly spaced apart angularly, or two hour sequences of numerals 31 inscribed thereon and ordered by increasing value from 1–12 respectively. As shown in FIG. 3, the two hour sequences of numerals 31 are arranged circularly and evenly spaced apart angularly, in which the first numeral "12" is inscribed in a top position, the second numeral "12" is inscribed in a bottom position, and the two numerals "6" are inscribed in a right and a left position. A minute portion 32 is positioned in an outer rim of the dial 30 and inscribed with a sequence of numerals ordered by increasing value from "1" to "60" which are arranged circularly and evenly spaced apart angularly with the numeral "60" inscribing in a top position and adjacent to the first numeral "12" of the hour sequence 31.

As shown in FIG. 3, a period portion 33 is provided on a central area of the dial 30 and is encircled by the hour sequences of numerals 31. The period portion 33 has a central cross inscription 331 having a vertical line 331*a* extended from top to bottom and a horizontal line 331*b* extended from left to right, so as to divide the period portion 33 into four sections 332, 333, 334, 335. On the top part of the vertical line 331*a*, a "day" mark is inscribed. On the bottom part of the vertical line 331*a*, a "night" mark is inscribed. Also, on the right part of the horizontal line 331*b*, an "a.m." mark representing ante meridian is inscribed. On the left part of the horizontal line 331*b*, a "p.m." mark representing post meridian is inscribed. Furthermore, on the top left and right sections 332, 333 of the period portion 33, a "MORNING" mark and an "AFTERNOON" mark are inscribed in predetermined positions respectively. Also, on the bottom right and left sections 334, 335 of the period portion 33, an "EVENING" mark and a "NIGHT" mark are inscribed in predetermined positions respectively. Besides, the bottom right and left sections 334, 335 has a darker background color. A circular sun mark 410 is affixed on the hour hand 41.

Referring to FIGS. 3 and 4, the time zone mechanism 50 is arranged in a receiving chamber C1 of a case C. The receiving chamber C1 is defined above the movement 40 which is installed within the lower portion of the case C. The time zone disc 51 of the time zone mechanism 50 is coaxially supported encircling the dial 30 by a supporting rim C2 provided in the upper periphery portion of the receiving chamber C1 of the case C in rotatable manner that a periphery time zone ring portion 511 formed at an outer rim portion of the time zone disc 51 is arranged to dispose around the periphery of the dial 30. The periphery time zone ring portion 511 of the time zone disc 51 has a plurality of time zone city indicators 512 thereon which are a plurality of city name inscriptions arranged in the same order as the time zones according to this first embodiment, as shown in FIG. 3. The time zone disc 51 has a central hole 513 having a diameter smaller than the diameter of the dial 30, wherein at least two supporting poles 301, 302 are extended from the bottom of the dial 30 to the bottom of the receiving chamber C1 in order to support the dial 30 in position.

The driving device 52 of this first embodiment comprises a driving gear 521 positioned in the receiving chamber C1 and mounted on an upper position, underneath the dial, of an hour axle 411. The hour axle 411 is extended from the movement 40 upwards into the receiving chamber C1 and drives the driving gear 521 to rotate simultaneously with the hour hand 41 in one revolution per 24 hours. A first outer ratchet ring 53, having a round sequence of outer ratchets 531 formed along an outer rim thereof, is coaxially protruded downwards from an outer periphery of the bottom surface of the time zone disc 51 within the receiving chamber C1. A second inner driven gear ring 54, having a sequence of inner gear teeth 541 formed along an inner rim thereof, is coaxially protruded downwards from an inner periphery of the bottom surface of the time zone disc 51 within the receiving chamber C1. The driven gear ring 54 is engaged with a driving transmission gear 55, which is rotatably mounted in the receiving chamber C1, by its inner gear teeth 541. A driven transmission gear 56 is concentrically and integrally connected below the driving transmission gear 55 by an adjusting axle 57 within the receiving chamber C1, so that the driven transmission gear 56 and the driving transmission gear 55 are rotated simultaneously along the adjusting axle 57. An idle gear 58 is mounted in a predetermined position in the receiving chamber C1 that it is engaged with the driving gear 521 and the driven transmission gear 56. Therefore, the time zone disc 51 is driven to rotate simultaneously with the driving gear 521 in one revolution per 24 hours via the idle gear 58, the driven transmission gear 56, the driving transmission gear 55, and the driven gear ring 54.

Referring to FIG. 5, the setting mechanism 60 is adapted to drive the time zone disc 51 to rotate independently until one of the time zone city indicators 512, representing a desired city of the time zones, aligned with the hour hand 41 so that, the current time of the other time zone city indicators 512 provided on the time zone ring portion 511 can be read simultaneously coincident with the corresponding hour numerals 31 inscribed on the dial 30 respectively.

The setting mechanism 60 according to the first embodiment comprises a setting member 61 pivotally mounted in the receiving chamber C1 by means of a mounting axle 62 to enable rotational motion around the mounting axle 62. The setting member 61 comprises a pivoting part 611 mounted on the mounting axle 62, a resilient pawl arm 612 extended from the pivoting part 611 to the ratchet ring 53 and a resilient clutch arm 613 extended from a lower portion of the pivoting part 611 in L-shape to the adjusting axle 57. The end of the pawl arm 612 provides a ratchet pawl 614 engaging against one of the ratchets 531 of the ratchet ring 53. The end of the clutch arm 613 is connected with the adjusting axle 57. The setting mechanism 60 further comprises a pusher member 63 disposed adjacent to the setting member 61.

The operation of the setting mechanism 60 is ensured by the application of a pushing pressure in the direction of arrow F, as shown in FIG. 5, against the pusher member 63 which then presses the clutch arm 613 of the setting member 61 to rotate in anti-clockwise direction around the mounting axle 62 synchronously. Therefore, the clutch arm 613 is pressed to pull the driving transmission gear 55 to disengage with the driven gear ring 54 of the time zone disc 51 temporary, so that the rotation of the time zone disc 51 stops due to the release of transmission. At the same time, the pawl arm 612 is driven to rotate anti-clockwise simultaneously, so that the ratchet pawl 614 thereof turns the ratchet ring 53 as well as the time zone disc 51 to rotate for one ratchet tooth displacement. When the pressure applied to the pusher member 63 releases, the pulling force to the driving transmission gear 55 is released and the driving transmission gear 55 re-engages with the driven gear ring 54 of the time zone disc 51, so that the time zone disc 51 is driven to rotate in one revolution per 24 hours by the driving device 52 again. Accordingly, the user can rotate the time zone disc 51 solely until one of the time zone city indicators 512, representing a desired city of the time zones, aligned with the hour hand 41 by repeatedly applying a predetermined number of pushing actions onto the pusher member 63.

In accordance with the above disclosure of the present invention, the setting operation of the present invention to a current local time is simple and convenience. Initially, set the time equipment to current local time by setting the positions of the hour hand 41 and minute hand 42, in an usual manner, to indicate the time corresponding to the city. In this operation, the time zone disc 51 is also driven in rotation synchronically with the hour hand 41 but the time, which is indicated by the hour hand 41 opposite the time zone city indicator 512 after the rotation of the time zone disc 51, generally does not correspond to the time of that time zone city indicator 512. Thereafter, the time zone disc 51 is operated solely to rotate by means of the pusher member 63 until the desired city name or symbol indicated by the desired time zone city indicator 512 is rotated to a position that aligns with the hour hand 41. Therefore, the current time of the desired city is indicated by the hour hand 41 and the current time of other time zone cities provided on the time zone ring portion 511 can also be read simultaneously coincident with the corresponding hour numerals 31 inscribed on the dial 30 respectively.

Figure 6:
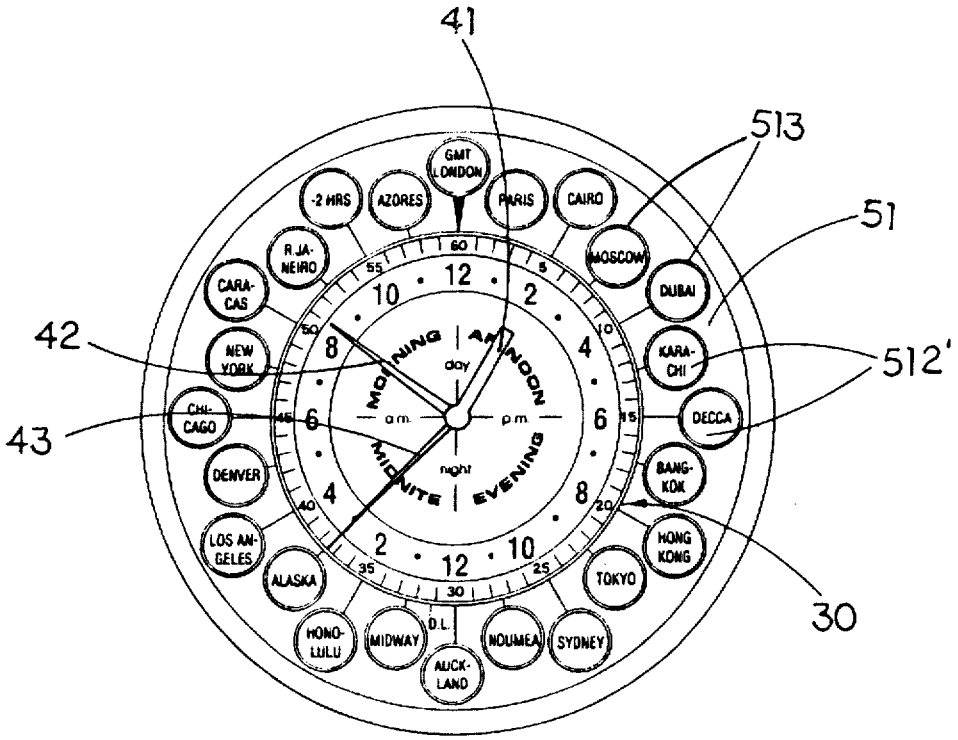
FIG. 6 is a front view of a time equipment having a 24-hour dial incorporated with a time zone disc which has a plurality of rotating indicating city discs disposed on a plurality of time zone openings formed on the time zone disc, according to a second preferred embodiment of the present invention.
Figure 7:
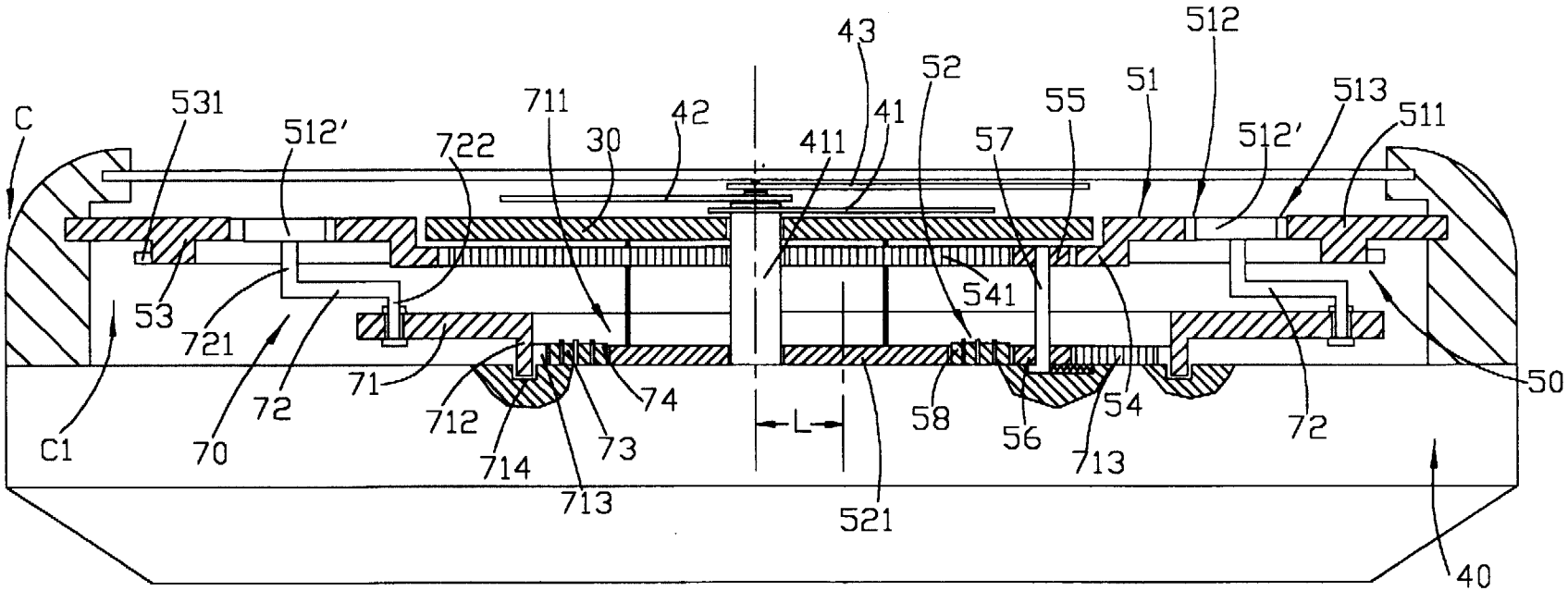
FIG. 7 is a schematic partial sectional view illustrating a maintaining mechanism incorporated with the driving device of the time zone mechanism according to the above second embodiment of the present invention.

Referring to FIGS. 6 and 7, a second preferred embodiment which is a modification of the above first embodiment of the present invention is illustrated. In this second embodiment, the time equipment of the present invention further comprises a maintaining mechanism 70, as shown in FIG. 7, incorporated with the time zone mechanism 50. The time zone disc 51 is driven to rotate in one revolution per 24 hours by the driving device 52 as in the above first embodiment. However, according to this second embodiment, the first outer ratchet ring 53 and the driver gear ring 54 are disposed apart to form a circular portion therebetween. The time zone disc 51 of this second embodiment has a plurality of time zone openings 513 arranged circularly and uniformly spaced apart angularly on the circular portion. Moreover, in accordance with the second embodiment, each of the time zone city indicators 512 of the time zone mechanism 50 comprises an indicating city disc 512', which has a corresponding time zone city or symbol inscribed thereon, and is supported to dispose on (or above, or underneath) the corresponding time zone opening 513 during the rotation of the time zone disc 51 by means of the maintaining mechanism 70. The maintaining mechanism 70 is adapted to drive the plurality of indicating city discs 512' to rotate independently so as to enable the time zone city or symbol on each indicating city disc 512' maintaining in upright position during the rotation of the time zone disc 51.

Figure 8:
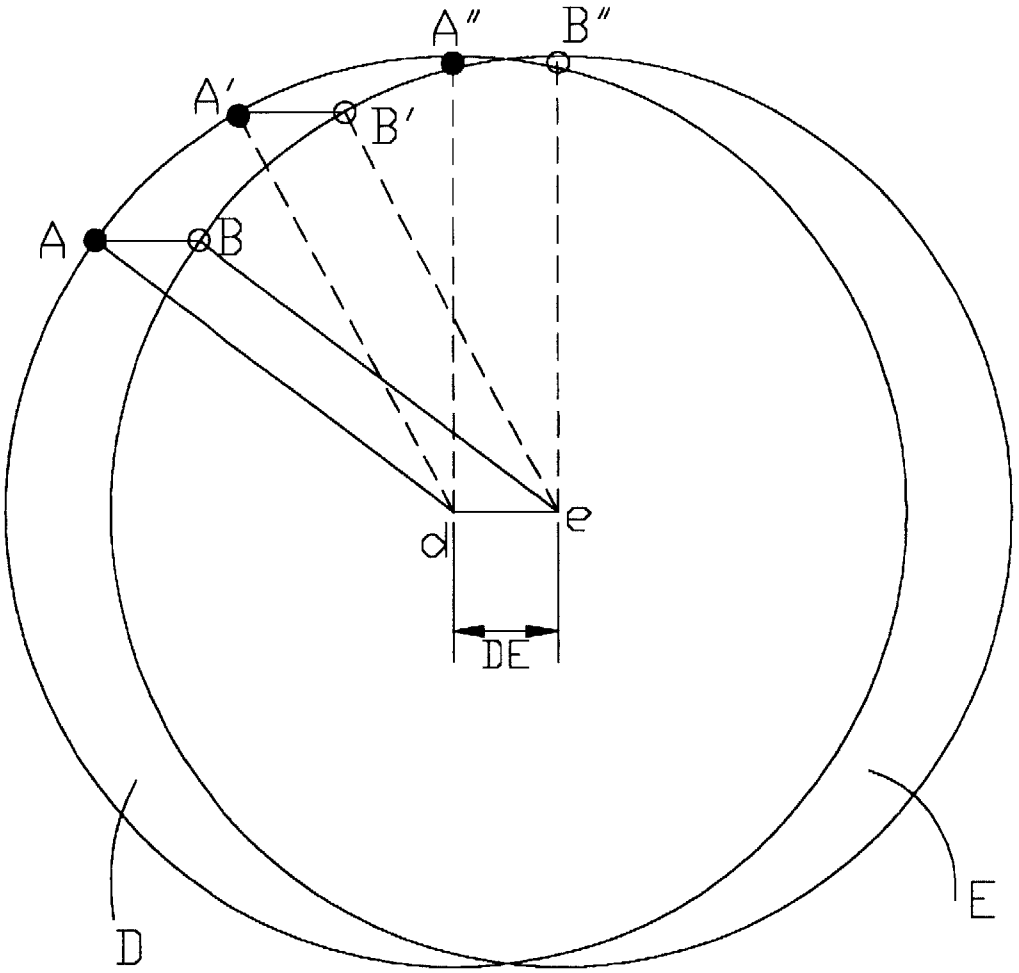
FIG. 8 is a geometrical drawing illustrating the relationship between the time zone disc and a transmitting wheel of the above second embodiment according to the present invention.

As shown in FIG. 8, a geometrical drawing showing the operational theory of the maintaining mechanism 70 is illustrated. Two circles D and E having same diameter are disposed with their centers d and e having a horizontal displacement DE. A plurality of marks, such as A, A', A" and B, B', B", etc., are arranged circularly and uniformly spaced apart angularly on the periphery of the two circles D and E respectively, wherein the distance lines AB, A'B' and A"B" between the marks A and B, A' and B', and A" and B" are equal to the displacement DE. When the circle D and circle E rotate simultaneously in the same speed, for example one revolution per 24 hours, every distance line AB, A'B' or A"B" between the marks A and B, A' and B', or A" and B" will be maintained in horizontal position. Such that, if the circle E is a first rotating disc and the marks B, B' and B" are pivoting axles rotatably mounted on the periphery of the first rotating disc E. The circle D is a second rotating disc and the marks A, A' and A" are indicating discs having predetermined inscriptions inscribed thereon respectively and mounted on the periphery of the second rotating disc D. The distance lines AB, A'B' and A"B" are a plurality of connecting rods connecting between the indicating discs A, A' and A" and the pivoting axes B, B' and B". The indicating disc A, A' and A" and the inscriptions thereon can be maintained in upright position during the simultaneous rotation of the first rotating disc E and the second rotating disc D.

The maintaining mechanism 70, as shown in FIG. 7, comprises a driving wheel 71 and a plurality of pivoting axles 72 disposed in the receiving chamber C1. The driving wheel 71 has a central hole 711 and a supporting ring 712 protruded downwardly. An inner circular surface of the supporting ring 712 provides a driven ring gear 713. The bottom surface of the receiving chamber C1 provides a circular groove 714 to receive a bottom end of the supporting ring 712 for supporting the driving wheel 71 in rotatable manner. The center of the driving wheel 71 as well as the center of the circular groove 714 are adjacent to the center of the time zone disc 51 as well as the hour axle 411 to define a distance L therebetween. A first transmission gear 73 disposed in the receiving chamber C1 is engaged with the driven ring gear 713. A second transmission gear 74 is engaged with the driving gear 521 mounted on the hour axle 411 and the first transmission gear 73, so that the driving wheel 71 is driven by the driving gear 521 via the first and second transmission gears 73 and 74 to rotate simultaneously with the time zone disc 51, i.e. one revolution per 24 hours.

Each pivoting axle 72 has a first end bending upwards to form a vertical top end portion 721 to affix to the bottom center of the corresponding city disc 512' and a second end bending downward to form a vertical bottom end portion 722 to pivotally mounted to a predetermined periphery position of the driving wheel 71. Therefore, the plurality of pivoting axles 72 are rotatably mounted to the outer periphery of the driving wheel 71 circularly and uniformly spaced apart angularly so as to position the plurality of indicating city discs 512' to the corresponding time zone openings 513 of the time zone disc 51 respectively.

Accordingly, when the time zone disc 51 and the driving wheel 71 are driven by the driving gear 521 to rotate simultaneously in one revolution per 24 hours, the indicating city discs 512' linked to the driving wheel 71 rotate respectively following the rotation of the time zone disc 51 along the hour axle 411. Therefore, each indicating city disc 512' remains in upright position by self rotation around the bottom end portion 722 of the corresponding pivoting axle 72, following the rotation of the driving wheel 71, so that the inscription of city name inscribed on the indicating city disc 512' can be maintained in upright position during the rotation of the time zone disc 51 for facilitating the reading of the time zone city name thereon, even the indicating city disc 512' being driven to a corresponding bottom position, for example the "12 a.m." position, of the dial 30.

Furthermore, since the indicating city discs 512' according to the present second embodiment can be maintained in upright position during the rotation of the time zone disc 51, the city names can be replaced respectively by city symbols, such as the specified drawings representing the cities, so as to further facilitate the distinction of various time zone cities and provide an innovating time zone disc appearance.

Figure 9:
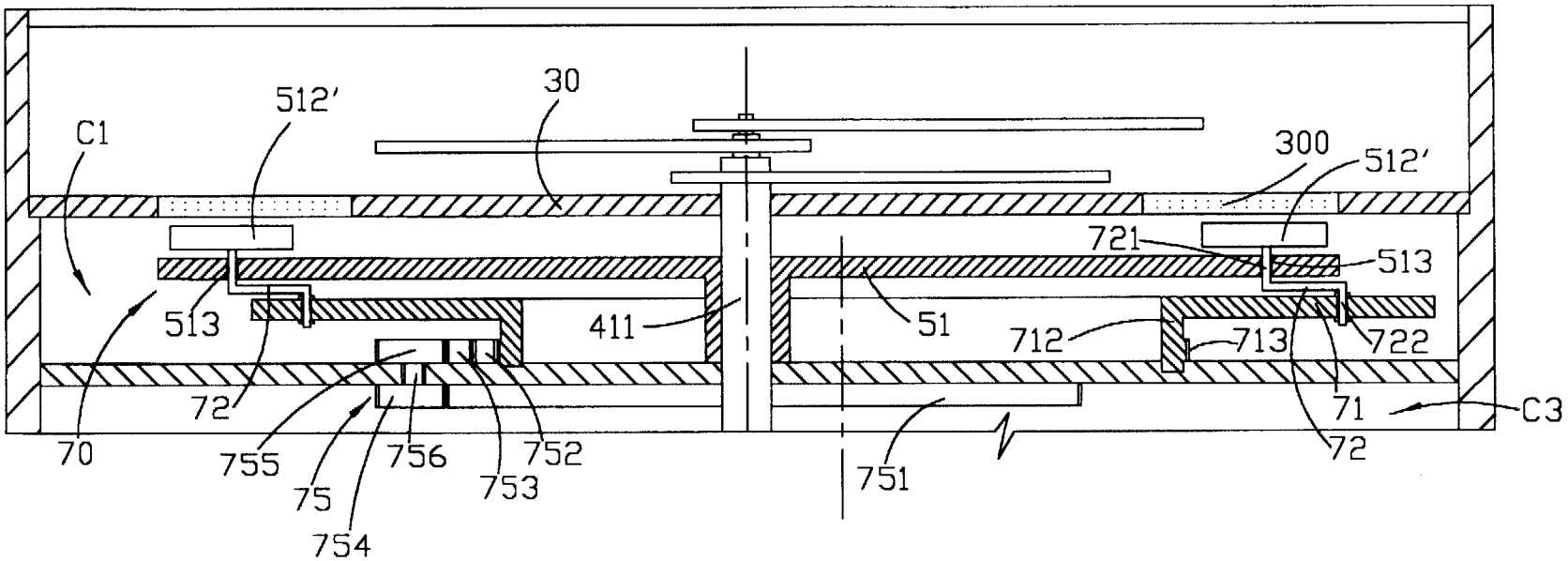
FIG. 9 is a schematic partial sectional view of a third preferred embodiment of the present invention, illustrating the driving device and the maintaining mechanism.
Figure 10:
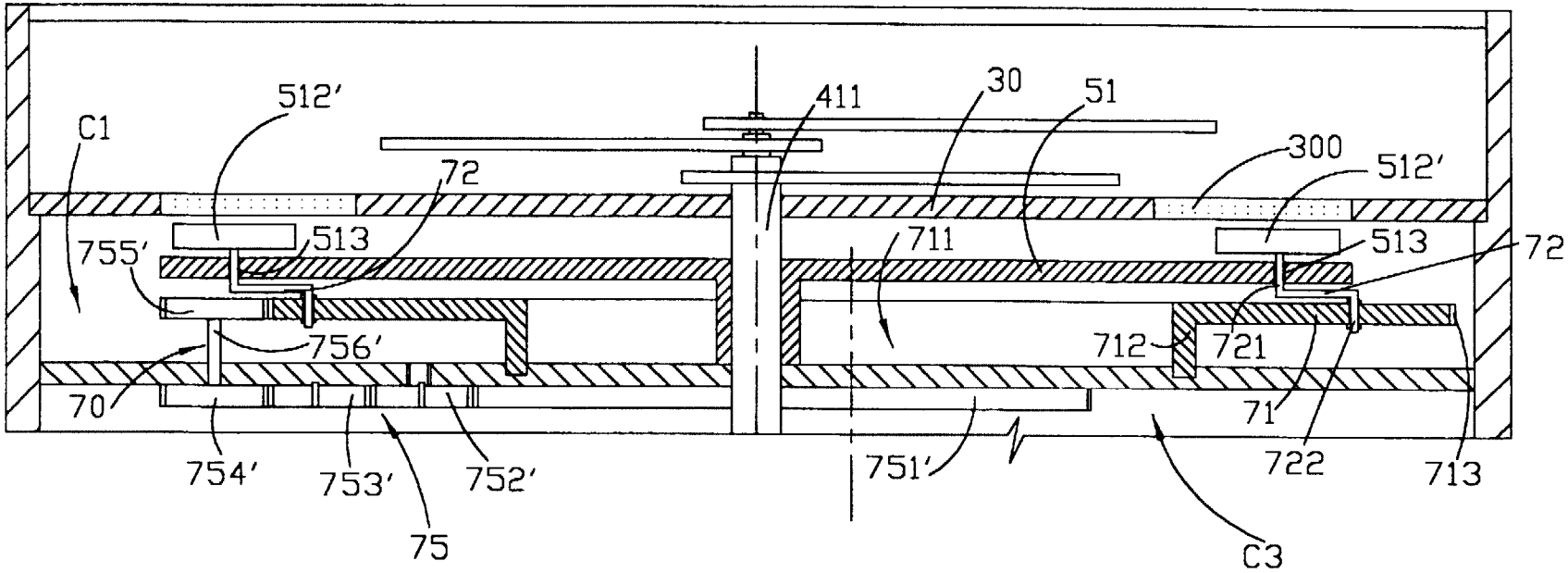
FIG. 10 is a schematic partial sectional view of an alternative mode of the driving device incorporated with the maintaining mechanism according to the above third embodiment of the present invention.

Referring to FIGS. 9 and 10, a third embodiment of the present invention is illustrated, which is another modification mode of the above disclosed second embodiment and can be specified to construct as a clock. In this third embodiment, the dial 30 is printed on a transparent disc 300 that the outer periphery portion of the transparent disc 300 is remained transparent for the observation of the indicating city discs 512'. The time zone disc 51 is disposed underneath the transparent disc 300 inside the receiving chamber C1 and integrally mounted on the hour axle 411 extending from the movement of the time equipment. A second chamber C3 is provided below the receiving chamber C1.

The periphery of the time zone disc 51 provides a plurality of time zone openings 513 arranging circularly and uniformly spaced apart angularly and having a diameter slightly larger than the diameter of the top end portion 721 of each pivoting axle 72. The top end portions 721 of the pivoting axles 72 are upwardly penetrated therethrough the corresponding time zone openings 513 and affixed to the bottom surfaces of the indicating city discs 512' respectively, so as to support the indicating city discs 512' above the time zone openings 513 respectively.

Referring to FIG. 9 of the third embodiment, the driving wheel 71 generally has the same configuration of the above second embodiment and is rotatably mounted in the receiving chamber C1 in the manner as mentioned in the second embodiment. However, the driven ring gear 713 is formed on the outer periphery surface of the supporting ring 712 instead of the inner circular surface of the supporting ring 712. Moreover, the rotation of the driving wheel 71 is driven by means of a transmission device 75 in accordance with this third embodiment. In this third embodiment, the transmission device 75 of the maintaining mechanism 70 comprises a transmission driving gear 751 integrally mounted on the hour axle 411 and disposed in the second chamber C3, a first idle gear 752 rotatably mounted in the receiving chamber C1 and engaged with the driven ring gear 713 and a second idle gear 753, a driven transmission gear 754 rotatably mounted in the second chamber C3 and engaged with the transmission driving gear 751, and a driving transmission gear 755 which is concentrically mounted above the driven transmission gear 754 by a transmission axle 756 so as to dispose in the receiving chamber C1 for engaging with the second idle gear 753. Therefore, the driving wheel 71 is adapted to be driven to rotate in one revolution per 24 hours by means of the transmission driving gear 751 via the first idle gear 752, the second idle gear 753, the driven transmission gear 754, and the driving transmission gear 755.

Referring to FIG. 10, an alternative mode of the third embodiment is illustrated. In this mode, the driving ring gear 713 is formed on its outer periphery rim instead of the inner circular surface of the supporting ring 712. The transmission device 75 of this alternative mode also comprises a transmission driving gear 751' integrally mounted on the hour axle 411 and disposed in the second chamber C3, a first idle gear 752' engaged with the transmission driving gear 751' and a second idle gear 753', a driven transmission gear 754' engaged with the second idle gear 753', and a driving transmission gear 755' which is concentrically mounted above the driven transmission gear 754' by a transmission axle 756' so as to dispose in the receiving chamber C1 for engaging with the driven ring gear 713'. Therefore, the driving wheel 71 is adapted to be driven to rotate in one revolution per 24 hours by means of the transmission driving gear 751' via the first idle gear 752', the second idle gear 753', the driven transmission gear 754', and the driving transmission gear 755'.

Figure 11A:
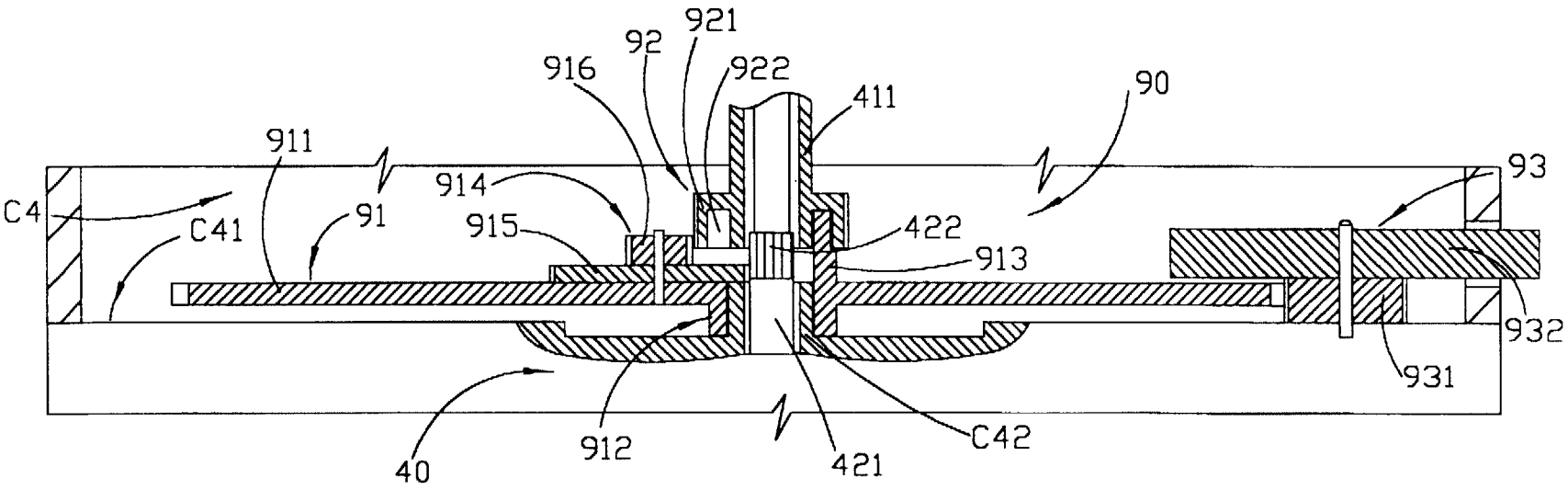
FIG. 11A is a schematic partial sectional view illustrating an hour axle transmitting and setting device according to a fourth preferred embodiment of the present invention.
Figure 11B:
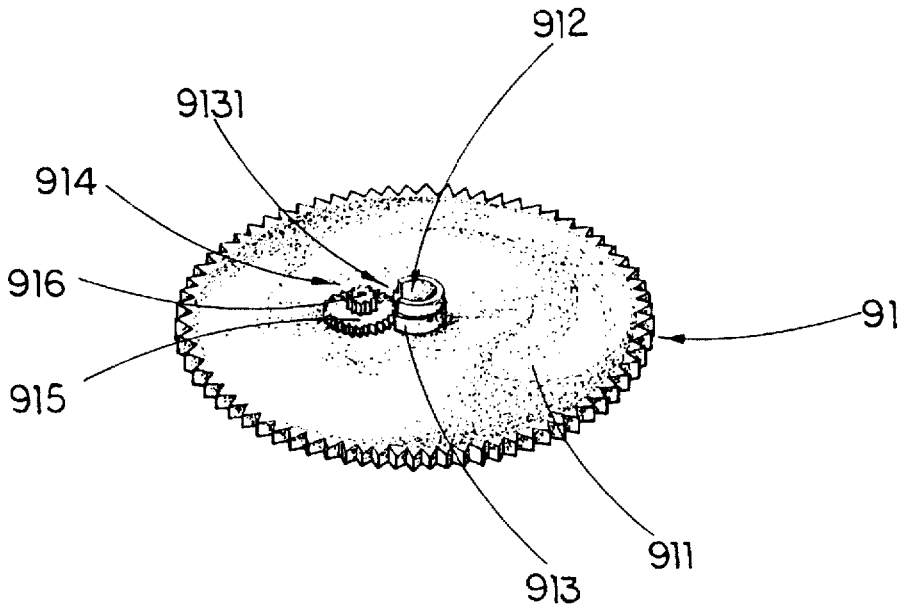
FIG. 11B is a perspective view of a transmitting unit of the hour axle transmitting and setting device according to the above fourth preferred embodiment of the present invention.

Referring to FIGS. 11A and 11B, a fourth preferred embodiment of the present invention is illustrated, which is a modification mode of the above first, second or third embodiment by further incorporating with an hour axle transmitting and setting device 90 for enabling the hour axle 411 to be transmitted to rotate one revolution per 24 hours by a minute axle 421 which is connected with the minute hand 42 above the dial 30 and driven to rotate one revolution per hour by means of the movement 40, and permitting the hour axle 411 to be driven to rotate independently so as to facilitate the setting procedure of the time equipment of the present invention as disclosed above when the user travels from the local city to another city.

As shown in FIG. 11A, the hour axle transmitting and setting device 90 is installed in a transmitting chamber C4 provided in an upper portion of the movement 40 when it is incorporated with the above first, second or third embodiment as shown in FIGS. 4, 7, 9 or 10, in which the transmitting chamber C4 of the movement 40 has a bottom surface C41 which central portion has a hollow mounting shaft C42. The minute axle 421, which is extended from the movement 40 through the transmitting chamber C4 by rotatably penetrating the mounting shaft C42, has a base gear 422 provided at a position above the mounting shaft C42 in the transmitting chamber C4. The hour axle transmitting and setting device 90 comprises a transmitting unit 91, an hour axle driven wheel 92 integrally connected to the base bottom of the hour axle 411, and a setting unit 93.

As shown in FIG. 11B, the transmitting unit 91 comprises a main gear 911 which has a central hole 912 and C-shaped connecting shaft 913 extending upwards from the circumferential boundary of the central hole 912. The main gear 911 is rotatably mounted on the mounting shaft C42 in the transmitting chamber C4, as shown in FIG. 11A. The transmitting unit 91 further comprises a gear unit 914 which comprises a bottom gear 915 and a top gear 916 concentrically and integrally formed on the bottom gear 915. As shown in FIGS. 11A and 11B, the gear unit 914 is rotatably mounted on the main gear 911 in a position opposing to an opened side 9131 of the C-shaped connecting shaft 913, so that the bottom gear 915 of the gear unit 914 is adapted to engage with the base gear 422 of the minute axle 421.

As shown in FIG. 11A, the hour axle driven wheel 92 has an hour gear 921 connected to the bottom of the hour axle 411 and a circular connecting recess 922 formed thereunder for concentrically and rotatably mounted on the C-shaped connecting shaft 913 in such a manner that the hour gear 921 of the hour axle driven wheel 92 is engaged with the top gear 916 of the gear unit 914 of the transmitting unit 91. Moreover, the gear number of the base gear 422, the bottom gear 915, the top gear 916, and the hour gear 921 are predetermined in a specific proportion for enabling the minute axle 421 to rotate one revolution while the hour axle 411 rotates just 1/24 revolution. Therefore, the hour axle 411 is driven to rotate one revolution per 24 hours by the top gear 916 of the gear unit 914, in which the bottom gear 915 of the gear unit 914 is driven to rotate by the base gear 422 of the rotating minute axle 421 which is driven to rotate one revolution per hour by the movement 40. At that stage, the main gear 911 is remained still.

As shown in FIG. 11A, the setting unit 93, which is rotatably mounted on the bottom surface C41 of the transmitting chamber C4, comprises a setting gear 931 engaged with the main gear 911 of the transmitting unit 91 and a setting wheel 932 coaxially and integrally connected on the setting gear 931 for driving the setting gear 931 to rotate. At least a portion of the setting wheel 932 is exposed to outside of the time equipment. Therefore, by turning the setting wheel 932 can drive the setting gear 931 to rotate and so does the main gear 911, so that the hour axle 411, as well as the hour hand 41 connected with the hour axle 411, are driven to rotate simultaneously and independently.

Since the current time difference between any two time zone cities is constant, the time setting operation becomes more convenience by incorporating with the hour axle transmitting and setting device 90 as disclosed above. Once the time equipment of the present invention is set to the current time of the local city, the user can alternatively observe the current time of another city inscribed on the time zone disc 51 by turning the setting wheel 932 to rotate the hour hand 41 independently to coincident with the desired city. Thus the time indicating by the hour hand 41, minute hand 42 and second hand 43 tells the exact current time of that desired city. In the other words, when the user travels from a home city to another city listed on the time zone disc 51, the user can simply turn the setting wheel 932 to drive the hour hand 41 independently to coincident with that desired city so as to reset the time indicating by the hour, minute and second hands 41, 42, 43 on the dial 30 to the current time of that city from the home city time.

Figure 12A:
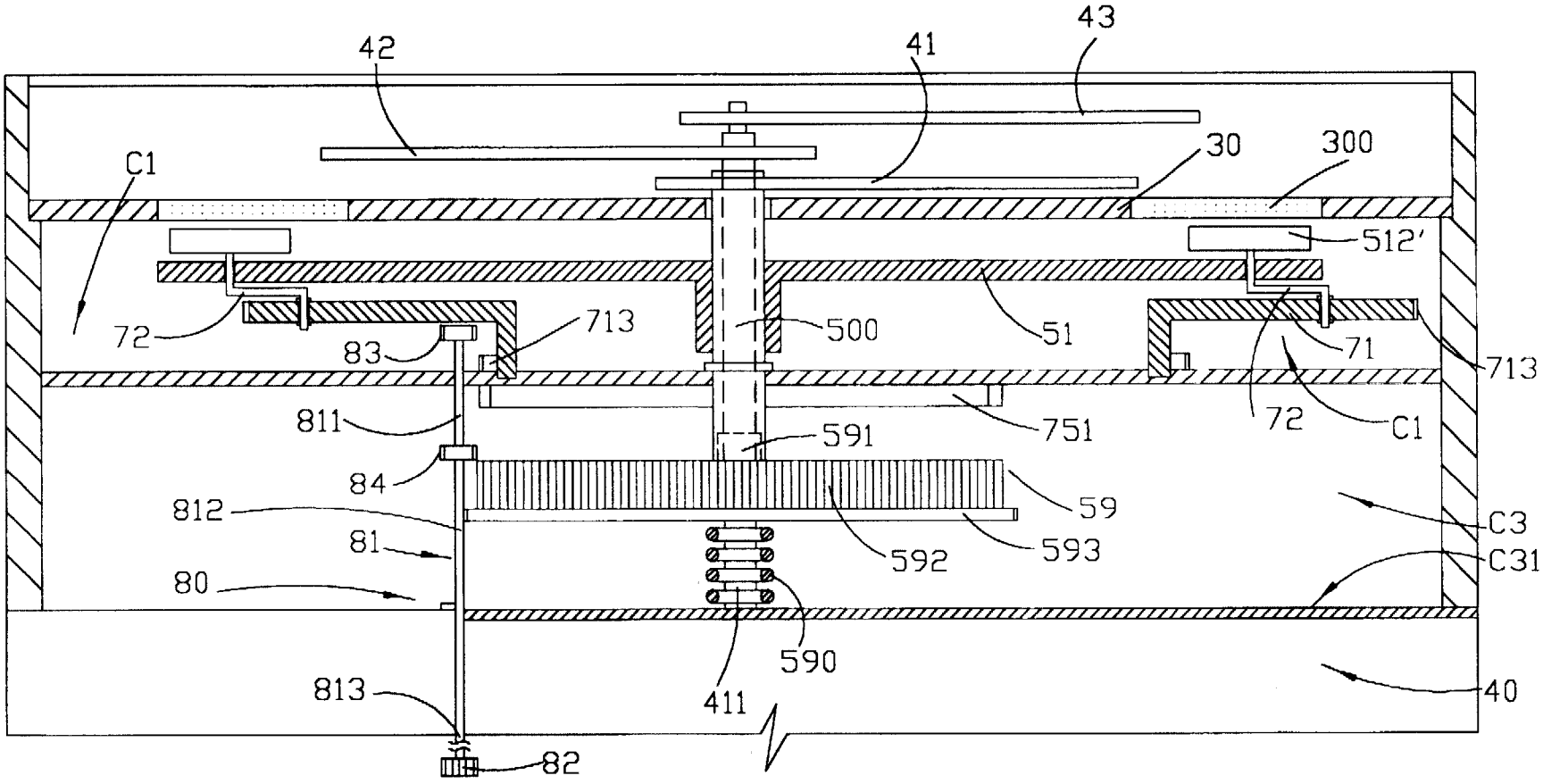
FIG. 12A is a schematic partial sectional view of a modification mode according to the above third preferred embodiment of the present invention, in which a specific setting mechanism incorporated with the maintaining mechanism in normal stage.
Figure 12B:
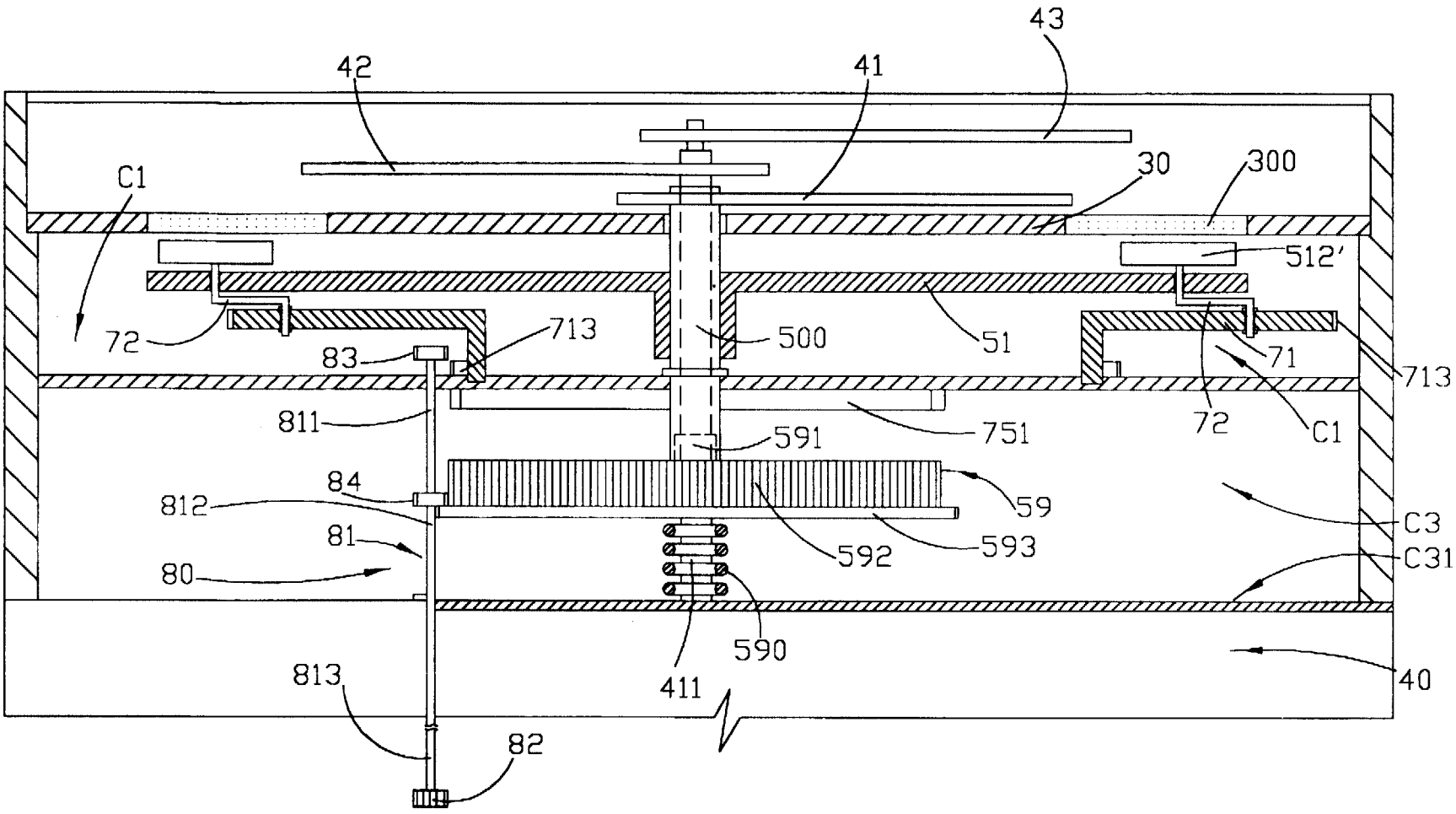
FIG. 12B is a schematic partial sectional view of the modification mode according to the above third embodiment of the present invention, illustrating the specific setting mechanism incorporated with the maintaining mechanism in time setting stage.
Figure 12C:
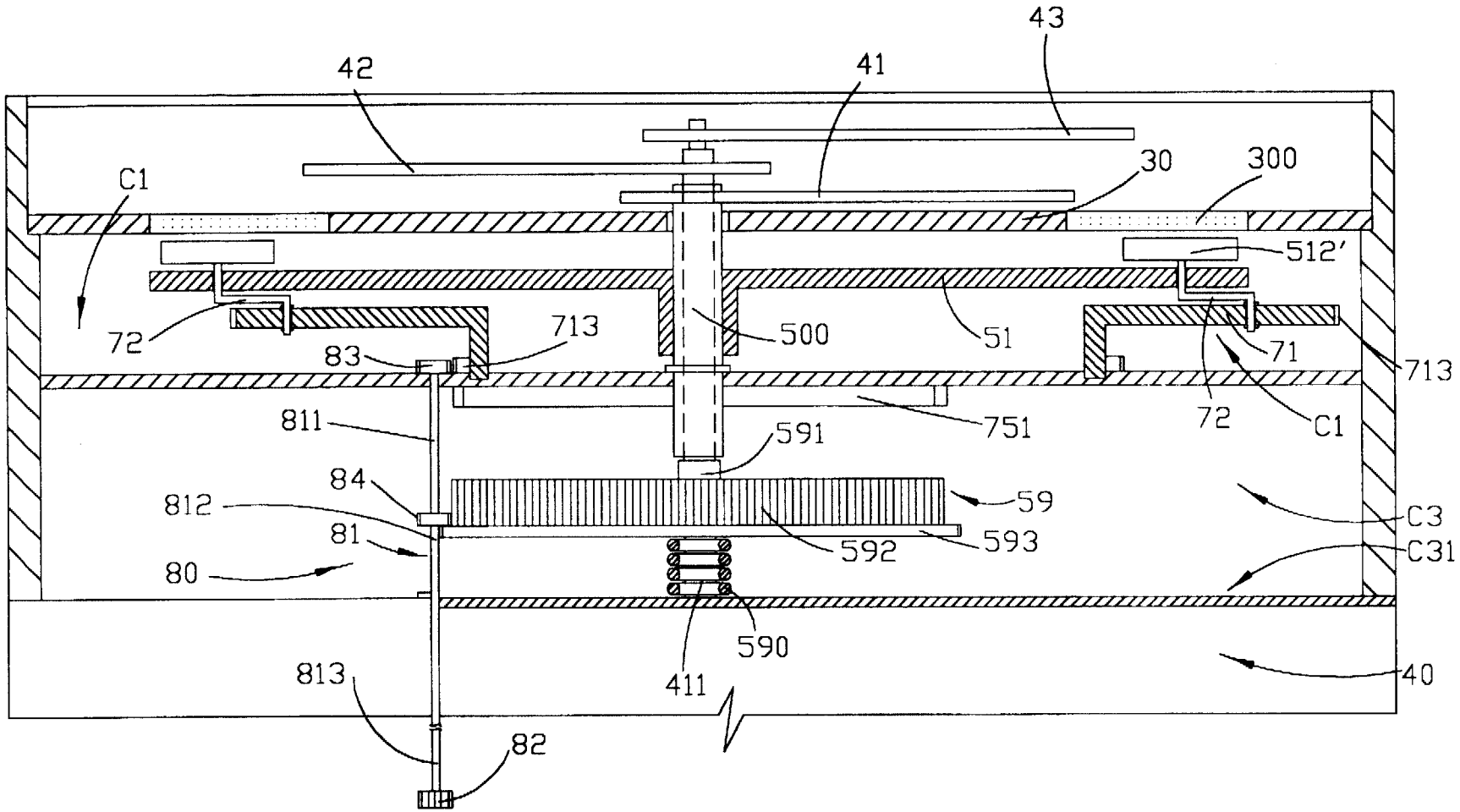
FIG. 12C is a schematic partial sectional view of the modification mode according to the above third embodiment of the present invention, illustrating the specific setting mechanism incorporating with the maintaining mechanism in time zone setting stage.

As shown in FIGS. 12A, 12B and 12C, a modification mode of the above third embodiment is illustrated. The dial 30 is printed on a transparent disc 300 that an outer periphery portion of the transparent disc 300 is remained transparent for the observation of the indicating city discs 512'. The time zone disc 51 is disposed underneath the transparent disc 300 inside the receiving chamber C1 and integrally mounted on a hollow driving axle 500 to which the hour axle 411 extending from the movement 40 of the time equipment is concentrically penetrated through to connected with the hour hand 41 above the dial 30. The upper end of the driving axle 500 is upwardly extended into the receiving chamber C1 and the bottom end of the driving axle 500 is downwardly extended into a second chamber C3 which is provided below the receiving chamber C1 and above the movement 40. The driving device 52 of this modification further comprises a clutch means 59 and a spring 590. The clutch means 59 is mounted on the hour axle 411 inside the second receiving chamber C3 in permitting axial displacement manner. The spring 590 is disposed between the bottom surface of the clutch means 59 and the bottom surface C31 of the second chamber C3. The spring 590 presses the clutch means 59 upwards for engaging the hour axle 411 with the driving axle 500 so that the driving axle 500 is driven to rotate simultaneously by the hour axle 411 so as to drive the time zone disc 51 to rotate simultaneously for one revolution in 24 hours.

The clutch means 59 provided on the top thereof a central engaging tube 591 which has a thickness equal to the clearance formed between the hour axle 411 and the driving axle 500. Therefore, when the engaging tube 591 is pressed upwards to insert into the bottom end of the driving axle 500 by the spring 590, an outer and inner coarse surfaces of the engaging tube 591 are engaged with an outer surface of the hour axle 411 and an inner surface of the bottom end of the driving axle 500 so as to couple the hour axle 411 and the driving axle 500 integrally for driving the driving axle 500 to rotate simultaneously by the hour axle 411.

The time equipment further comprises a setting mechanism 80. The clutch means 59 further comprises a periphery clutch gear 592 and a stop rim 593 protruded at the bottom end of the clutch means 59. The setting mechanism 80 comprises a setting pole 81 having a top portion 811 extended into the receiving chamber C1, a middle portion 812 extended through the second chamber C3 and a bottom portion 813 extended outside of the time equipment to affix a setting button 82. A first setting gear 83 is affixed to the top end of the top portion 811 and a second setting gear 84 is affixed to a predetermined position of the middle portion 812. Normally, the spring 590 supports and presses the clutch means 59 in normal position, as shown in FIG. 12A. In this normal position, the first setting gear 83 and the second setting gear 84 do not engaged with the driven ring gear 713 nor the clutch gear 592 respectively.

As shown in FIG. 12B, when the time indicating by the hour hand 41 and minute hand 42 is required to re-adjust, pull the setting pole 81 outward until the second setting gear 84 is engaged with the clutch gear 592 and stopped by the stop rim 593. At this stage, the first setting gear 83 is still remained not to engaged with the driven ring gear 713 of the driving wheel 71. Therefore, turning of the button 82 to rotate the setting pole 81 can drive the clutch gear 592, as well as the driving axle 500 and the hour axle 411, to rotate simultaneously by means of the second setting gear 84, so as to rotate the hour hand 41 and the minute hand 42 to the current time.

As shown in FIG. 12C, the time zone disc 51 can be operated solely to rotate until the desired city name or symbol indicated by the desired indicating city disc 512' is rotated to a position that aligns with the hour hand 41. Such time zone adjustment can be operated by further pulling the setting pole 81 further outward, so as to pull the clutch means 59 to move downward and press against the spring 590 until the engaging tube 591 of the clutch means 59 is withdrawn from the driving axle 500 and the first setting gear 83 is engaged with the driving ring gear 713. At that stage, the engaging tube 591 is also disengaged with the hour axle 411 so that the driving axle 500 is disengaged with the hour axle 411. The driving of time zone disc 51 and the driving wheel 71 by the hour axle 411 is then released and the time zone disc 51 becomes free of rotation. Turning of the button 82 at this moment can drive the driving wheel 71 to rotate by means of the first setting gear 83, so that the time zone disc 51 can also be driven to rotate simultaneously by means of the plurality of pivoting axles 72. Therefore, the current time of the desired city is indicated by the hour hand 41 and the current time of other time zone cities provided on the time zone disc 51 can be read simultaneously coincident with the corresponding hour numerals inscribed on the dial 30 respectively.

Figure 13:
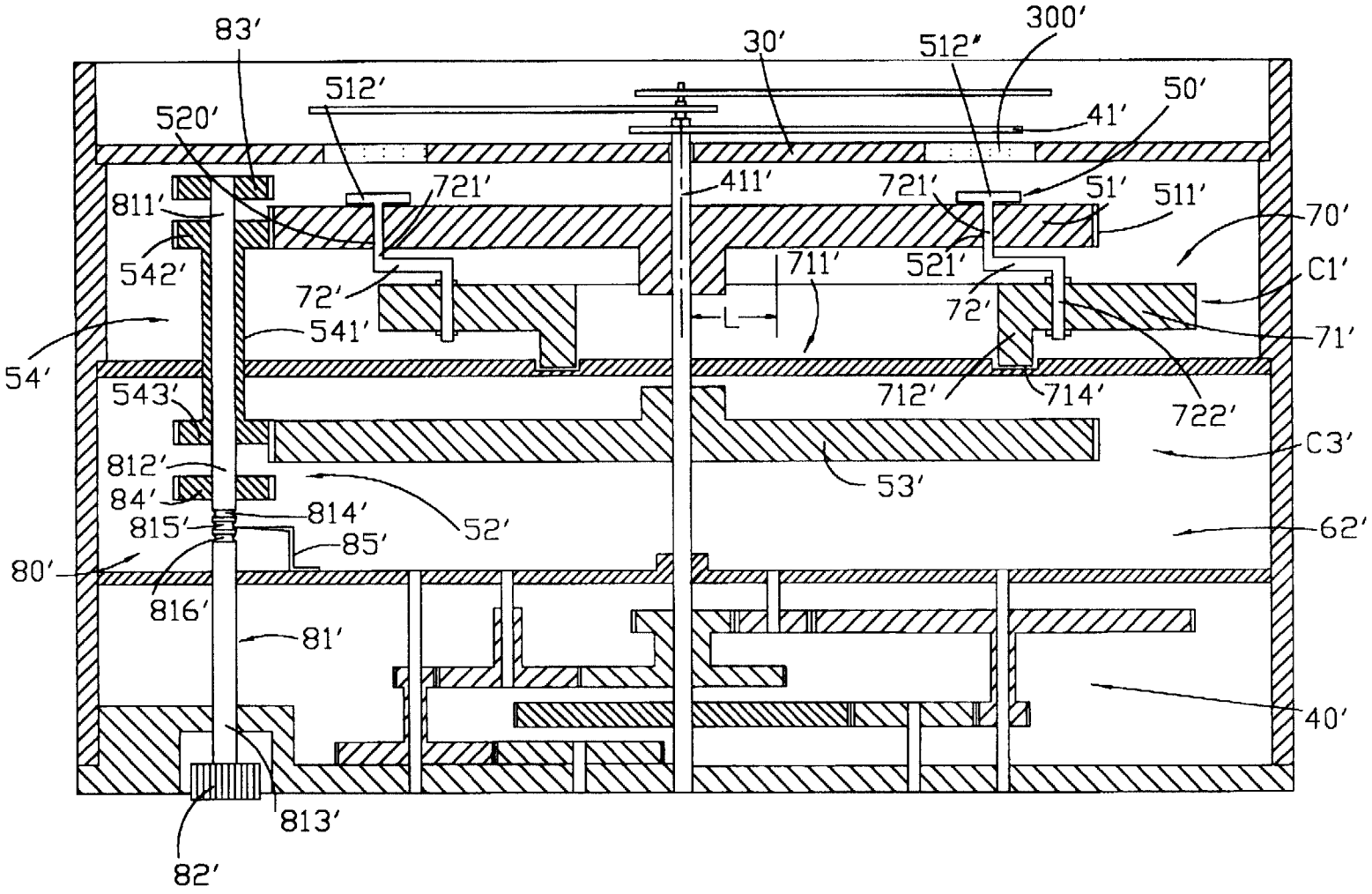
FIG. 13 is a schematic sectional view of a time equipment according to a fifth preferred embodiment of the present invention.

Referring to FIG. 13, a fifth embodiment of the present invention is illustrated. The time zone mechanism 50' of the time equipment, which is a clock, comprises a time zone disc 51' disposed in a receiving chamber C1' below a dial 30' which is printed on the central portion of a transparent disc 300'. The time zone disc 51' is integrally mounted on an hour axle 411' below the dial 30' in the receiving chamber C1' and has an outer driven gear 511' provided at an outer circumference of the time zone disc 51'. On the outer periphery portion of the time zone disc 51', a plurality of time zone city indicators 512" are provided circularly and uniformly spaced apart angularly. The plurality of time zone city indicators 512" are a plurality of inscriptions of city name or symbol arranged in the same order as the time zones. The hour axle 411' is extended from a movement 40' upwards through a second chamber C3', which is positioned between the receiving chamber C1' and the movement 40', and the receiving chamber C1' for connecting with an hour hand 41' above the dial 30' and driving the hour hand 41' to rotate for one revolution per 24 hours.

The time zone mechanism 50' further comprises a driving device 52'. The driving device 52' comprises a driver gear 53', which is integrally mounted on the hour axle 411' in the second receiving chamber C3', having the same diameter of the time zone disc 51'. The driving device 52' further comprises a transmission means 54' which has a hollow pole body 541', atop transmission gear 542' engaged with the driven gear 511' of the time zone disc 51' and a bottom transmission gear 543' engaged with the driver gear 53'.

On an outer periphery portion of the time zone disc 51', a plurality of time zone openings 52' is provided and disposed corresponding to the location of the plurality of time zone city indicators 512" respectively. The time zone indicators are a plurality of indicating city discs 512" mounted above the time zone openings 52' respectively in accordance with this fifth embodiment.

The time equipment of this fifth embodiment further comprises a maintaining mechanism 70' rotatably disposed in the receiving chamber C1'. The maintaining mechanism 70' comprises a driving wheel 71' and a plurality of pivoting axles 72'. The driving wheel 71' has a central hole 711' and a supporting ring 712' protruded downwards from its bottom surface. A bottom surface of the receiving chamber C1' provides a circular groove 714' to receive the bottom end of the supporting ring 712' for supporting the driving wheel 71' in rotatable manner. The center of the driving wheel 71' as well as the center of the circular groove 714' are adjacent to the center of the time zone disc 51' as well as the hour axle 411' to define a distance L' therebetween.

Each pivoting axle 72' has a first end bending upward to form a vertical top end portion 721' which is rotatably penetrated through the time zone openings 52' respectively and affixed to the bottom center of the corresponding indicating city disc 512", and a second end bending downward to form a vertical bottom end portion 722' to pivotally mounted to a predetermined periphery position of the driving wheel 71'. Therefore, the plurality of pivoting axles 72' are rotatably mounted to an outer periphery of the driving wheel 71' circularly and uniformly spaced apart angularly so as to position the plurality of indicating city discs 512" corresponding to the time zone openings 52' of the time zone disc 51' respectively.

Accordingly, when the time zone disc 51' and the driving wheel 71' are driven by the driver gear 53' to rotate simultaneously in one revolution per 24 hours, the indicating city discs 512" linked to the driving wheel 71' rotate respectively following the rotation of the time zone disc 51' around the hour axle 411'. However, each indicating city disc 512" remains in upright position by self rotation around the bottom end portion 722' of the corresponding pivoting axle 72' following the rotation of the driving disc 71', so that the inscription of city name inscribed on each indicating city disc 512" can be maintained in upright position during the rotation of the time zone disc 51', so as to facilitate the reading of the time zone city name thereon even the indicating city disc 512" is rotated to a corresponding bottom position of the dial 30', for example the "12 a.m." position.

The time equipment of this fifth embodiment further comprises a setting mechanism 80'. The setting mechanism 80' comprises a setting pole 81' rotatably penetrating through the hollow pole body 541' of the transmission means 54'. The setting pole 81' has a top portion 811' extended into the receiving chamber C1', a middle portion 812' extended through the second chamber C3' and a bottom portion 813' extended outside of the time equipment to affix a setting button 82'. A first setting gear 83' is affixed to the top end of the top portion 811' and a second setting gear 84' is affixed to a predetermined position of the middle portion 812'. The bottom portion 813' of the setting pole 81' further provides three step grooves 814', 815' and 816'. The setting mechanism 80' further comprises a holding means 85' adapted to selectively engage with one of the step grooves 814', 815', 816'.

In normal stage, the holding means 85' is engaged with the middle step groove 815' and, at that moment, the first setting gear 83' and the second setting gear 84' do not engaged with the driven gear 511' of the time zone disc 51' nor the driver gear 53' respectively. Therefore, the time zone disc 51' is driven to rotate simultaneously by the driver gear 53' via the driving device 54'.

When the setting pole 81' of the setting mechanism 80' is pushed inwards by pressing the setting button 82', the holding means 85' engages with the lower step groove 816'. In this stage, the top and bottom transmission gears 542', 543' are disengaged with the driven gear 511' and the driver gear 53' respectively, and that the second setting gear 84' is engaged with the driver gear 53 while the first setting gear 83' remains disengaged with driven gear 511' of the time zone disc 51'. Therefore, the user can rotate the hour axle 411' by turning the setting button 82' so as to adjust the current time indicating by the hour hand 41'.

When the setting pole 81' of the setting mechanism 80' is pulled outward by pulling the setting button 82', the holding means 85' engages with the upper step groove 814'. In this stage, the top and bottom transmission gears 542', 543' are disengaged with the driven gear 511' and the driver gear 53' respectively, and that the first setting gear 83' is engaged with the driven gear 511' of the time zone disc 51' while the second setting gear 84' remains disengaged with the driver gear 53', so that the user can rotate the time zone disc 51' by turning the setting button 82' to adjust the desired indicating city disc 512" coincident with the hour hand 41'.

In accordance with the embodiments described above, the time equipment of the present invention provides a time zone disc rotating automatically one revolution per 24 hours so that one of the time zone city marks, which represents a predetermined city, is able to rotate simultaneously to follow the rotation of an hour hand of the time equipment. Therefore, the user may simultaneously observe all the current time of all the time zone city marks provided on the time zone disc. Moreover, in the second, third, fourth, and fifth embodiments, all the time zone city names or symbols of the time zone disc are capable of maintaining in upright position during the rotation of the time zone disc so as to facilitate the reading of the time zone city names or symbols thereon.

With the invention thus explained, it is obvious to those skilled in the art that various modifications and variations can be made without departing from the scope and spirit of the present invention. It is therefore intended that this invention be limited only as in the appended claims.

I claim:

1. A time equipment, comprising a 24-hour dial having a plurality of hour numerals inscribed thereon;

an hour hand and a minute hand mounted for rotating above said dial;

a movement for driving said hour hand to rotate one revolution per 24 hours and said minute hand to rotate one revolution per hour;

a time zone mechanism comprising a time zone disc rotatably and coaxially mounted adjacent to said dial, said time zone mechanism further comprising a driving device for driving said time zone disc to rotate one revolution per 24 hours, and that said time zone disc of said time zone mechanism has an outer time zone ring portion which is disposed around the periphery of said dial and provided with a plurality of time zone city indicators arranging in a predetermined order;

a setting mechanism for said time zone mechanism, wherein said setting mechanism is adapted to drive said time zone disc to rotate independently until one of said time zone city indicators is aligned with said hour hand, so that the current time of said other time zone city indicators are capable of being read simultaneously coincident with said plurality of corresponding hour numerals inscribed on said dial respectively; and a maintaining mechanism incorporated with the time zone mechanism, in which said time zone disc has a plurality of time zone openings arranged circularly and uniformly spaced apart angularly, each of said time zone city indicators comprising an indicating city disc which has a corresponding time zone city inscribed thereon and is supported to dispose on said corresponding time zone opening by means of said maintaining mechanism, and that said maintaining mechanism is adapted to drive said plurality of indicating city discs to rotate independently so as to enable said indicating city discs maintaining in upright position respectively during the rotation of said time zone disc.

2. A time equipment, as recited in claim 1, in which said maintaining mechanism comprises a driving wheel, which is driven to rotate in one revolution per 24 hours, having a central hole and a supporting ring protruded from a bottom surface of said driving wheel for mounting said driving wheel in said receiving chamber in rotatable manner, and that a center of said driving wheel is adjacent to said time zone disc's center to define a predetermined distance therebetween, moreover, said maintaining mechanism further comprising a plurality of pivoting axles, each of said pivoting axles having a first end affixed to said corresponding indicating city disc and a second end pivotally mounted to a predetermined periphery position of said driving wheel, so that said plurality of pivoting axles are rotatably mounted to said outer periphery of said driving wheel circularly and uniformly spaced apart angularly so as to position said plurality of city discs corresponding to said time zone openings of said time zone disc respectively, wherein a distance between said first end and said second end of each said pivoting axle is equal to said predetermined distance between said driving wheel's center and said time zone disc's center.

3. A time equipment, as recited in claim 2, in which said first end of each said pivoting axle is bent upwards to form a vertical top end portion to affix to a center of said bottom surface of said corresponding city disc and said second end of each said pivoting axle is bent downwards to form a vertical bottom end portion to pivotally mount to said predetermined periphery position of said driving wheel,.

4. A time equipment, as recited in claim 3, in which a bottom surface of said receiving chamber provides a circular groove to receive a bottom end of said supporting ring for supporting said driving wheel in rotatable manner.

5. A time equipment, as recited in claim 1, in which said time zone disc of said time zone mechanism is disposed in a receiving chamber below said dial which is printed on a central portion of a transparent disc, and that said time zone disc is integrally mounted on an hour axle in said receiving chamber and has an outer driven gear provided at an outer circumference of said time zone disc, wherein on an outer periphery portion of said time zone disc, a plurality of time zone city indicators are provided circularly and uniformly spaced apart angularly, and that said hour axle is extended from said movement upwards through a second chamber positioned between said receiving chamber and said movement and said receiving chamber for connecting with said hour hand above said dial, and that said driving device of said time zone mechanism comprises a driver gear and a transmission means, said driver gear being integrally mounted on said hour axle in said second chamber and has a diameter equal to that of said time zone disc, and that said transmission means has a hollow pole body, a top transmission gear engaged with said driven gear of said time zone disc, and a bottom transmission gear engaged with said driver gear, and that on an outer periphery portion of said time zone disc, a plurality of time zone openings is provided and disposed corresponding to the location of said plurality of time zone city indicators respectively, and that said time zone city indicators comprises a plurality of indicating city discs mounted above said time zone openings respectively, and that said maintaining mechanism which is rotatably disposed in said receiving chamber comprises a driving wheel and a plurality of pivoting axles, and that said driving wheel has a central hole and a supporting ring protruded downwards from its bottom surface, a bottom surface of said receiving chamber providing a circular groove to receive a bottom end of said supporting ring for supporting said driving wheel in rotatable manner, wherein a center of said driving wheel is adjacent to a center of said time zone disc to define a predetermined distance therebetween, and that each of said pivoting axles has a first end and a second end, said first end being bent upward to form a vertical top end portion which is rotatably penetrated through said corresponding time zone opening and affixed to a bottom center of said corresponding indicating city disc, said second end being bent downward to form a vertical bottom end portion to pivotally mounted to a predetermined periphery position of said driving wheel, wherein a distance between said first end and said second end of each said pivoting axle is equal to said predetermined distance between said driving wheel's center and said time zone disc's center, and that said plurality of pivoting axles are rotatably mounted to an outer periphery of said driving wheel circularly and uniformly spaced apart angularly so as to position said plurality of indicating city discs corresponding to said time zone openings of said time zone disc respectively, thereby when said time zone disc and said driving wheel are driven by said driver gear to rotate simultaneously in one revolution per 24 hours, said indicating city discs linked to said driving wheel rotate respectively following said rotation of said time zone disc around said hour axle, in order to maintain each indicating city disc in upright position by self rotation around said bottom end portion of said corresponding pivoting axle following said rotation of said driving disc.

6. A time equipment, as recited in claim 5, in which said setting mechanism comprises a setting pole rotatably penetrating through said hollow pole body of said transmission means, said setting pole having a top portion extended into said receiving chamber, a middle portion extended through said second receiving chamber, and a bottom portion extended outside of said time equipment to affix a setting button, and that a first setting gear is affixed to a top end of said top portion and a second setting gear is affixed to a predetermined position of said middle portion, moreover, a bottom portion of said setting pole further providing three step grooves, and that said setting mechanism further comprises a holding means adapted to selectively engage with one of said step grooves; wherein in normal stage, when said holding means is engaged with said middle step groove and said first setting gear, said second setting gear do not engaged with said driven gear of said time zone disc and said driver gear respectively, so that said time zone disc is driven to rotate simultaneously by said driver gear via said driving device; wherein when said setting pole of said setting mechanism is pushed inwards by pressing said setting button, said holding means engages with said lower step groove and said top and bottom transmission gears are disengaged with said driven gear and said driver gear respectively, and that said second setting gear is engaged with said driver gear while said first setting gear remains disengaged with driven gear of said time zone disc, so that said hour axle is capable of rotating by turning said setting button to adjust a current time indicating by said hour hand; wherein when said setting pole of said setting mechanism is pulled outwards by pulling said setting button, said holding means engages with said upper step groove, and that said top and bottom transmission gears are disengaged with said driven gear and said driver gear respectively, and that said first setting gear is engaged with said driven gear of said time zone disc while said second setting gear remains disengaged with said driver gear, so that said time zone disc is capable of rotating rotated by turning said setting button to adjust one of said indicating city disc coincident with said hour hand.

7. A time equipment, as recited in claim 6, in which said dial has two hour sequences of numerals which are ordered by increasing value from 1–12 inscribed thereon respectively and arranged circularly and evenly spaced apart angularly, wherein said first numeral "12" is inscribed in a top position, said second numeral "12" is inscribed in a bottom position, and said two numerals "6" are inscribed in a right and a left position, a minute portion which is positioned in an outer rim of said dial and inscribed with a sequence of numerals ordered by increasing value from "1" to "60" which are arranged circularly and evenly spaced apart angularly with said numeral "60" inscribing in a top position adjacent to said first numeral "12" of said hour sequence, said dial further having a period portion which is provided on a central area of said dial and encircled by said hour sequences of numerals, wherein said period portion has a central cross inscription having a vertical line extended from top to bottom and a horizontal line extended from left to right so as to divide said period portion into four sections, a "day" mark being inscribed on a top part of said vertical line, a "night" mark being inscribed on a bottom part of said vertical line, an "a.m." mark representing ante meridian being inscribed on a right part of said horizontal line, a "p.m." mark representing post meridian being inscribed on a left part of said horizontal line, a "MORNING" mark and an "AFTERNOON" mark being inscribed in predetermined positions on a top left and right sections of said portion respectively, an "EVENING" mark and a "NIGHT" mark being inscribed in predetermined positions on a bottom right and left sections of said period portion respectively, furthermore, said bottom right and left sections having a dark background color and a circle sun mark being affixed on said hour hand.

* * * * *